US005275291A

United States Patent [19]

Sledge

[11] Patent Number: 5,275,291

[45] Date of Patent: Jan. 4, 1994

[54] TABLET DISPENSER

[75] Inventor: Larry C. Sledge, Midlothian, Va.

[73] Assignee: Tredegar Industries Inc., Richmond, Va.

[21] Appl. No.: 30,705

[22] Filed: Mar. 15, 1993

Related U.S. Application Data

[63] Continuation-in-part of Ser. No. 868,971, Apr. 16, 1992.

[51] Int. Cl.[5] ..... B65D 85/56; B65D 6/06

[52] U.S. Cl. ..... 206/531; 206/532; 206/540; 206/1.5; 206/807; 220/281; 220/347; 220/348

[58] Field of Search ..... 220/346, 347, 348, 281; 206/528, 529, 531, 532, 534, 540, 1.5, 807

[56] References Cited

U.S. PATENT DOCUMENTS

| | | | |
|---|---|---|---|
| 3,888,350 | 6/1975 | Horvath | 206/531 |
| 3,987,891 | 10/1976 | Horvath | 220/347 X |
| 4,007,828 | 2/1977 | Mayled | 206/1.5 |
| 4,192,422 | 3/1980 | Kotyuk | 220/346 X |
| 4,284,204 | 8/1981 | Carey, Jr. | 220/346 |
| 4,561,544 | 12/1985 | Reeve | 220/346 X |
| 4,817,819 | 4/1989 | Kelly | 206/531 X |
| 5,082,137 | 1/1992 | Weinstein | 220/346 |

*Primary Examiner*—Steven N. Meyers
*Assistant Examiner*—Jacob K. Ackun, Jr.
*Attorney, Agent, or Firm*—Dallett Hoopes

[57] ABSTRACT

A child-resistant, elderly friendly dispensing container comprises a housing having an opening in its top wall and a drawer which slideably fits in the housing. The drawer has a front cavity section and a rear latch section. The latch section includes a horizontally disposed resilient panel formed with an upward button which, when the drawer is closed, extends up through the opening in the top wall of the housing and forms an automatic latch, holding the drawer closed. In order to open the drawer, the button must be depressed and, at the same time, the drawer must be pulled out from the housing. The top of the housing is formed, adjacent the opening for the button, with a relief zone into which the button moves when the drawer is in dispensing position and blocks further opening.

31 Claims, 6 Drawing Sheets 712
720
716
718
736a
780
756
722
32a
32a
736
772
780c
726
774
728

756
714

756b
756
722
714

734
780c
770
T
780a 780b
780c
780a
T 712
720
716
30a
30a
722
728

756b
720
756
756c
756a
714

720
756
756c
714

720
756

TABLET DISPENSER

CROSS REFERENCE TO RELATED APPLICATIONS

This application is a continuation-in-part of application Ser. No. 07/868,971 filed Apr. 16, 1992.

BACKGROUND OF THE INVENTION

1. Field of the Invention

This invention relates to a tablet dispenser and is particularly noteworthy for being child resistant and, at the same time, elderly friendly. More specifically, the invention relates to a container and dispenser for tablets which may be opened only upon the combined execution of two simple separate operations beyond the ability of a young child, but readily performable by the elderly.

With the concern about accessibility to medication which may be toxic to infants, there has been a flood of different dispensing containers which resist opening by a young child. Often these containers have required special manipulation, adult strength and good eyesight to operate and have been based on the ability of the user to understand directions usually imprinted on the container. Some, for instance, have required force in a certain spot.

In some cases, the aim to make a container or dispenser child resistant has been taken to extremes and has prevented the access by those for which use of the contents are intended: the elderly have been frustrated because they have neither the strength or cognitive skills to perform the needed operations. In such cases the purpose of the dispensing container, to dispense, has itself been defeated.

2. Description of Related Art including Information Disclosed under §§1.97 to 1.99

Examples in the prior art of such structures are found in U.S. Pat. No. 3,563,368 which issued Feb. 16, 1971 to Wilfred L. McHugh; U.S. Pat. No. 4,113,098 which issued Sep. 12, 1978 to Charles S. Howard; U.S. Pat. No. 4,126,224 which issued Nov. 21, 1978 to Robert H. Laauwe et al; U.S. Pat. No. 4,844,284 which issued Jul. 4, 1989 to Edward Drozd et al. These are examples of containers which generally require the manipulation of one part relative to another.

SUMMARY OF THE INVENTION

A dispensing container comprises an open-fronted housing having an opening in its top wall and a drawer which slideably fits in the housing. The drawer has a front cavity section and a rear latch section. The latch section includes a horizontally disposed resilient panel formed with an upward button which, when the drawer is closed, extends up through the opening in the top wall of the housing and forms a latch, holding the drawer closed. In order to open the drawer, the button must be depressed and, at the same time, the drawer must be pulled out from the housing. The top of the housing is formed, adjacent the opening for the button, with a relief zone such as an opening or a domed section into which the button moves when the drawer is in dispensing position. The configuration of the dome and button cooperate to block further opening of the drawer.

Variations of the invention include a projection in the opening which fits into a recess in the button to prevent opening until the button has been depressed. Also, a trap may be incorparated into the structure which only makes one tablet available for each opening of the drawer. In another variation the cavity section is a zig-zag channel in which tablets flow visible through the cover which is transparent marked with indicia to indicate the days of the month so that the taking of the daily tablet will be remembered. In still another version the resilient panel is a separate metal spring rather than an integral part of the molded drawer.

Further versions include ones in which the resilient latch panel is defined by spaced parallel slits, and ones wherein the floor of the drawer is apertured and receives a multiblister pill pack with the blisters in registry with the apertures.

BRIEF DESCRIPTION OF THE DRAWINGS

Further features and objects of the invention will be apparent from the following specification and the drawings, all of which show non-limiting embodiments of the invention. In the drawings:

FIG. 12*a* is a view similar to FIG. 12 showing a modified bottom wall;

DESCRIPTION OF THE PREFERRED EMBODIMENT

Figure 1:
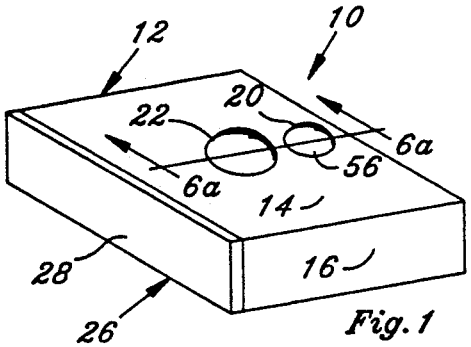
FIG. 1 is a perspective view of a tablet dispenser embodying the invention in closed condition.
Figure 9:
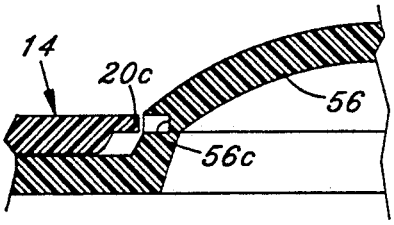
FIG. 9 is an enlarged view comparable to FIG. 7 showing a modification to the button and opening.

A dispenser embodying the invention is generally designated 10 in FIG. 1. It comprises an open-fronted housing 12 having a top wall 14 and side walls 16 and drawer retaining means which may be a partial bottom wall 18 (FIG. 9). A cutout 18*a* in the bottom wall may provide access to the bottom of the drawer 26.

The top wall is formed intermediate the side wall 16 with an opening 20. Longitudinally spaced and in line with the opening 20 is a relief zone in the form of a domed section 22. The housing may be molded of a suitable plastic such as high-density polyethylene or polypropylene.

Slideably disposed in the housing is a molded plastic drawer 26. The drawer comprises a front end panel 28 having marginal portions which, when the dispenser is closed, butt against the front of the housing (FIG. 1). The drawer is defined by a front tablet-receiving cavity section 30 and rear latch section 32. The sections are integral, formed preferably as one unitary piece.

Figure 3:
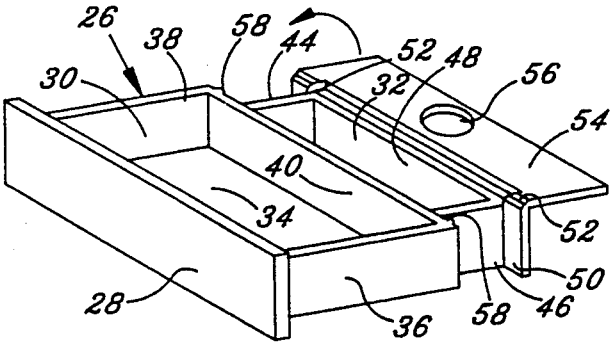
FIG. 3 is a slightly enlarged perspective view showing the drawer embodying the invention and having its hinged resilient panel in the unassembled position.

The cavity section comprises a floor or bottom wall 34, side walls 36, 38 and a rear wall 40. The latch section 32 includes the floor or bottom wall 42, the side walls 44, 46, and the rear wall 48. As shown in FIG. 3, the side walls 44, 46 are shorter and closer together than the side walls 36, 38 of the cavity section but the rear wall 48 extends beyond the side walls in extensions 50.

To the upper end of these extensions 50 a "living hinge" 52 hingedly supports a resilient hinge panel 54, formed centrally (FIG. 3) with a downward domed-shape button 56. Rearward nibs 58 are formed on the rear wall 40 of the cavity section outside the side walls 44, 46 of the latch section.

Figure 4:
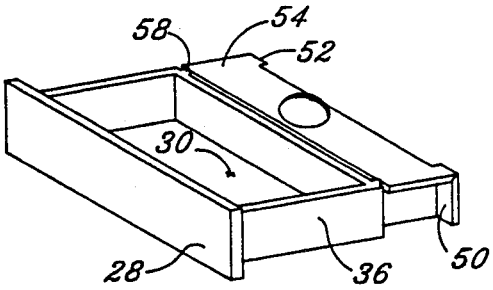
FIG. 4 is a perspective view showing the panel in assembled position.
Figure 4A:
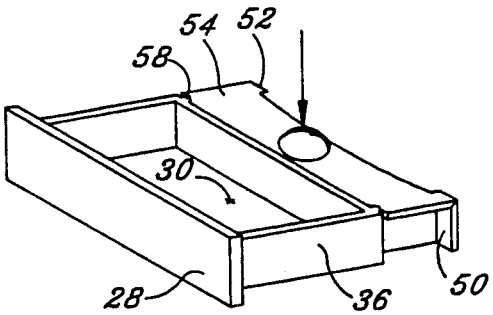
FIG. 4*a* shows the panel depressed in its mid-section as when the button is pressed.
Figure 13:
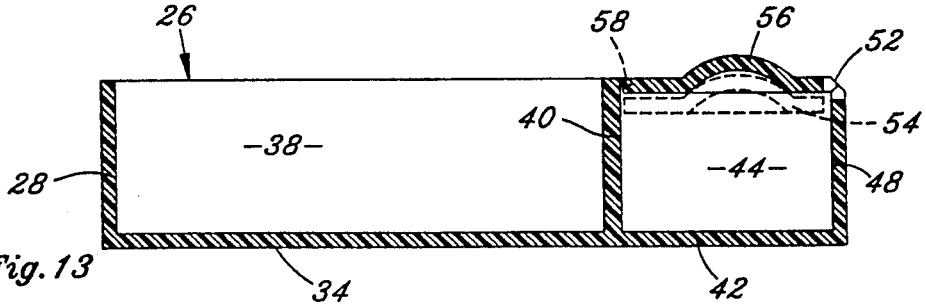
FIG. 13 is an enlarged sectional view taken on the line 13—13 of FIG. 4.

In assembly the resilient panel 54 hinged at 52 is folded over (see arrow FIG. 3) and its distal edge is tucked under the nibs 58. This holds the panel in position, resting on the upper edges of the side walls 44, 46 of the latch section 32. Because the panel 54 is resilient and only supported at its opposite ends, the button 56 may be pressed downward (FIGS. 4*a* and 13) and will return to its original position by the resilience of the material.

Preferably the entire drawer assembly as shown in FIG. 3 is molded to form a unitary integral piece as described and shown. The plastic material may be high-density polyethylene or polypropylene, for example. Polypropylene has been found to make the best-acting spring panel 54.

Figure 5:
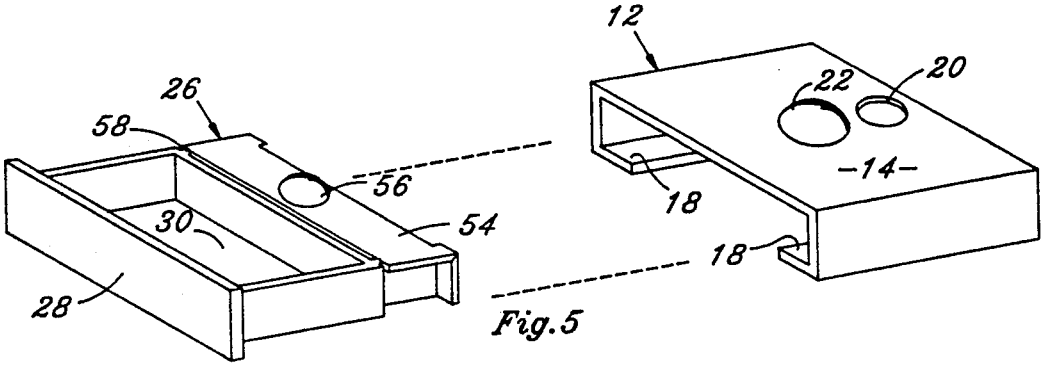
FIG. 5 is an exploded view showing the drawer and housing before assembly.

FIG. 5 shows the drawer, assembled, about to be slid into the open-fronted housing 12. In this insertion the rear wall 48 of the latch assembly is aligned with the front opening in the housing 12 and the button 56 is depressed to permit the drawer to enter the opening. As the drawer is slid into the housing, the top wall 14 holds the button 56 depressed.

As the drawer is inserted farther, the button 56 moves up into the relief zone or dome 22 (FIG. 6*c*) so that the resilient panel 54 is allowed to revert to its normal flat condition. Forcing the drawer in farther causes the cam undersurface 22*b* of the dome 22 to engage the top of the button 56 and force it downward again. When, thereafter, the drawer is totally installed, the button 56 will move up in the opening 20, automatically latching the drawer in the closed position (FIGS. 1, 7).

Figure 2:
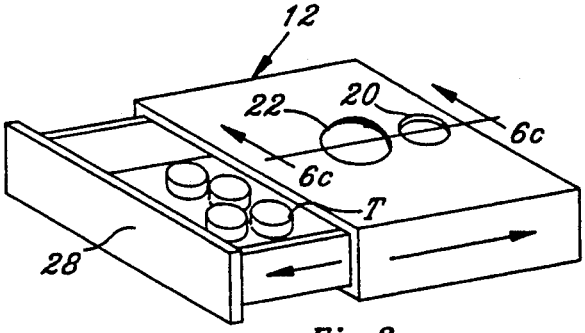
FIG. 2 is a perspective view showing the dispenser in dispensing condition.
Figure 6A:
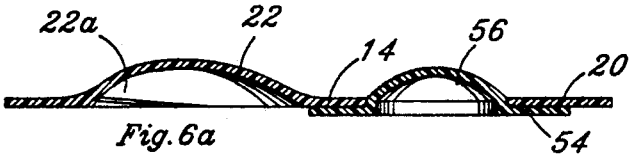
FIG. 6*a* is an enlarged fragmentary sectional view taken on the line 6*a*—6*a* of FIG. 1.
Figure 6B:
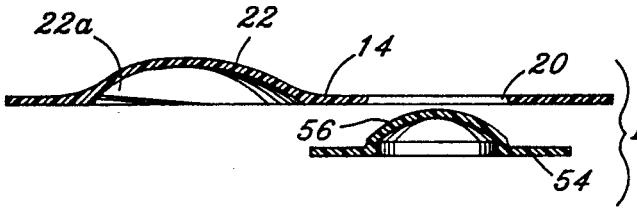
FIG. 6*b* is similar to 6*a* but showing the button depressed in preparation for opening of the drawer.
Figure 12:
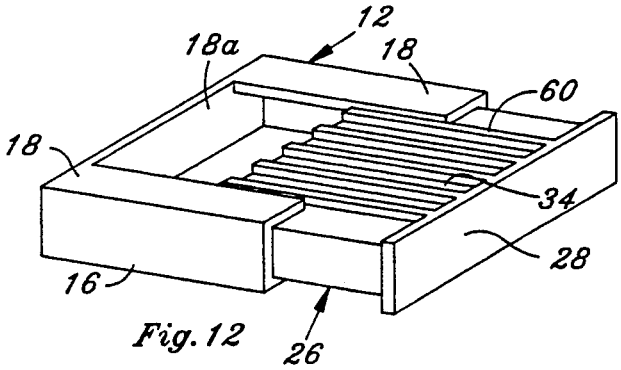
FIG. 12 is a perspective bottom view of the dispenser showing the drawer in open condition.

Assuming that the cavity section 30 is filled with tablets such as T in FIG. 2, the dispenser may be opened only upon the depressing of the button 56 flexing the panel 54 into the position shown in FIG. 6*b*. Simultaneously with or after the depression of the button 56, the drawer 26 may be opened, the user grasping the drawer on its front upper edge (FIG. 1) and through the opening 18*a* (FIG. 12) in the partial bottom wall. The bottom 34 is provided with the strengthening ribs 60 as shown in FIG. 12. To assist in the opening of the drawer, the ribs may be formed perpendicular to those shown, transverse to the drawer. In the FIG. 12*a* version the bottom wall 18 extends in a bridge 18*b* across the width of the housing at the rear thereof to provide a surface on the opposite side of the dispenser from the button. This arrangement makes it easy for the user to put a forefinger on bridge 18*b* and a thumb on the button and squeeze the button down to open the drawer. The ribs 60′ are shortened so as not to interfere with the bridge.

Figure 6C:
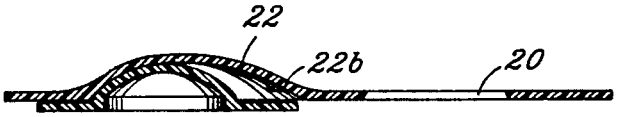
FIG. 6*c* is an enlarged fragmentary sectional view taken on the line 6*c*—6*c* of FIG. 2.

Once the depressed button passes out of alignment with the opening 20, it stays down, held down by the top wall 14 until it reaches the relief zone or domed section 22 whereupon it is permitted to raise to the position shown in FIG. 6*c*, leaving the drawer in the dispensing position as shown in FIG. 2. Because the button is permitted to raise in the domed section after opening, the spring panel 54 is fully relieved. This ensures against a "cold set" of the panel which might otherwise happen if the package were left open for prolonged periods of time with the button down. Clearly such a "cold set" would leave the spring panel 54 less functional at the expense of child resistants. The dome 22 thus comprises a relief zone. Instead of a dome 22, the relief zone may be a simple opening in the wall 14 to permit popping up of the button.

Figure 7:
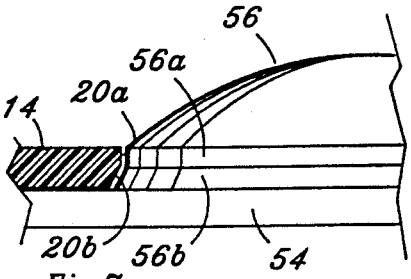
FIG. 7 is a greatly enlarged fragmentary view of a portion of FIG. 6*a* showing the interfitting of the button and top wall of the housing, the button and panel being in profile.
Figure 8:
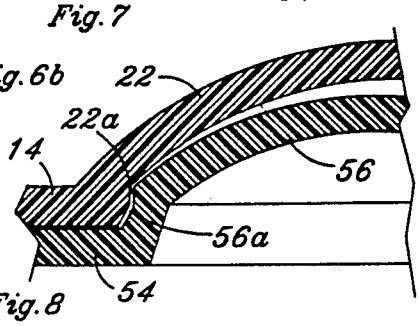
FIG. 8 is a greatly enlarged view of a portion of FIG. 6*c*.

As will be noted, in FIG. 7 the button 56 is formed with a transitional vertical edge 56*a*. This edge, when the drawer is in the dispensing position of FIG. 2, butts against the vertical shoulder 22*a* formed in the underside of the domed section 22 (FIG. 8). As these vertical surfaces butt, there is a positive stop to further opening of the drawer 26.

Subsequent closing of the drawer is effected as described in connection with the assembly of the dispenser above. The forceful closing causes the sloping cam surface 22*b* (FIG. 6*c*) of the domed section to urge the button 56 downward, permitting closing of the drawer. When the button 56 aligns with the opening 20 in the housing, it raises to the position shown in FIGS. 6*a* and 7.

Just as the button is formed with a vertical section 56*a*, the opening 20 has a confronting vertical section 20*a* (FIG. 7). These vertical sections, butting together, will frustrate any attempt to open the drawer without depressing the button 56.

Figure 10:
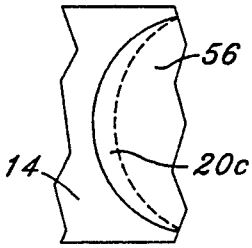
FIG. 10 is a fragmentary top view of a part of FIG. 9.
Figure 11:
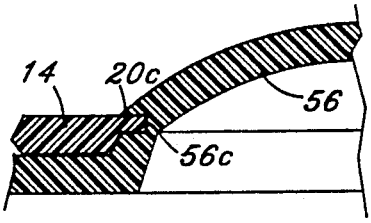
FIG. 11 is comparable to FIG. 9 showing the lock engaged.

As shown in FIGS. 9 through 11, the opening 20 may be formed in a modification with a tongue 20*c* and the button 56 with a peripheral recess 56*c* facing the tongue. When an attempt is made to open the drawer without depressing the button in this modification, the tongue 20*c* is received into the tongue recess 56*c*, locking the drawer against further opening. Thereafter, to open the drawer it is necessary to fully reclose the drawer, press the button and then open the drawer.

It should be noted in FIG. 7 that beneath the vertical sections 20*a* and 56*a* on the button and in the opening respectively, there is a chamfer 20*b* on the opening and a fillet 56*b* on the button. Cooperating, the fillet and chamfer serve to center the button in the opening as the button moves up. This assures that when the drawer is closed, the button is up at maximum engagement with the margin of the opening 20.

It will be clear from the aforegoing description that in order to open the drawer to the dispensing position shown in FIG. 2, it is necessary for the user to depress the button 56 so that the vertical section of the button 56*a* clears the vertical section 20*a* of the opening 20. At the same time, the drawer 26 must be drawn out by grasping the drawer by its bottom surface 34 and the top edge of the front wall 28, for instance. These two operations, which must be done simultaneously, are totally beyond a young child. At the same time, however, the elderly can understand the need for performing the two operations simultaneously and the pressing, gripping and pulling will come naturally to him or her. The dispenser is thus child resistant and elderly friendly.

MODIFICATIONS

Figure 14:
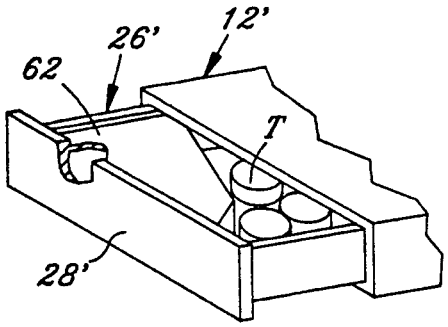
FIG. 14 is a fragmentary perspective view of a modification of the invention allowing access to one tablet at a time.

Modifications of the invention are shown in FIGS. 14 through 20. In FIG. 14 the drawer 26′ is provided with a spacing block 62 which takes up the major portion of the front of the drawer but stops well short of the rightward corner (FIG. 14) so that a single tablet is exposed when the drawer is open. This assures that only one tablet at a time can be removed from the dispenser when the drawer is open. What this arrangement does is to localize the dispensing of tablets from one side of the drawer only. It is intended as a convenience to the user. Further, if the dispenser is on a flat surface when the drawer is open, it will mean that only one tablet can be dispensed. Obviously, if the dispenser is tilted forward, additional tablets will be available one after the other. The block 62 is slanted at its inward end to funnel the tablets down toward the dispensing space at the right hand end of the drawer.

Figure 15:
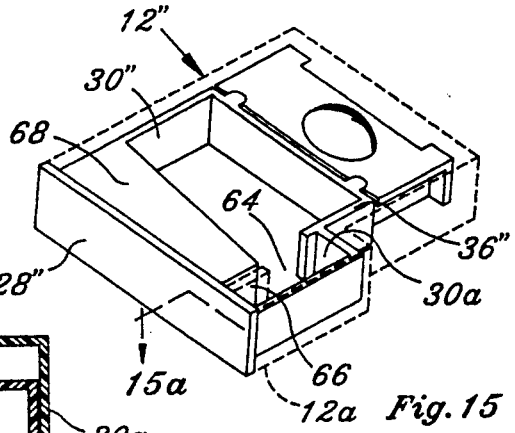
FIG. 15 is a perspective view of further modification showing the housing in dotted lines and presenting a trap in which only one tablet is dispensed per opening of the drawer.
Figure 15A:
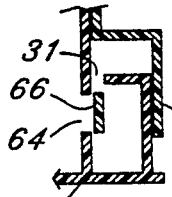
FIG. 15*a* is a fragmentary sectional view taken on line 15*a*—15*a* of FIG. 15.

The FIGS. 15, 15*a* modification is more elaborate. The idea here is to dispense one tablet and one tablet only for each opening of the drawer. This is effected by providing a rightward extension 30*a* of the cavity section 30″ as well as an extension 12*a* of the housing 12″, shown in dotted lines in FIG. 15. This extension 30*a* is accessed by a passage 64 in the side wall 36″ of the cavity section. Additionally, depending down from the top wall 14″ adjacent the front thereof is a partition 66. The rear wall of the extension 30*a* is vertically slotted at 31 (FIG. 15*a*) to pass the partition 66 in assembly.

The operation of the FIG. 15, 15*a* modification is simple. With the drawer closed within the housing, the dispenser is shaken and a single tablet moves through the passage 64 into the extension 30*a* of the cavity section. Subsequently, when the drawer is opened (FIG. 15*a*), the partition 66 (being fixed on the housing 12″) aligns with the passage 64 so that no further tablets can enter the extension 30*a*. A blocking ledge 68, which angles across the front of the cavity section 30″ acts in much the same way the block 62 does in the FIG. 14 embodiment and makes tablets in the main part of the cavity section inaccessible. Once the isolated tablet is removed from extension 30*a*, no further tablet will appear there until the drawer is closed, the dispenser shaken and the drawer reopened.

Figure 16:
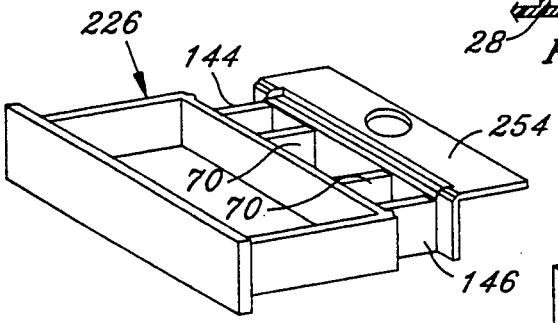
FIG. 16 is comparable to FIG. 3 but showing a modified latch section.

The FIG. 16 embodiment, as compared with the FIG. 3 preferred embodiment, includes in the drawer 226 the additional support walls 70, spaced inward from the walls 146, 144 and providing the panel 254 with more closely placed support means to limit the flexibility of the button if desired or necessary.

Figure 17:
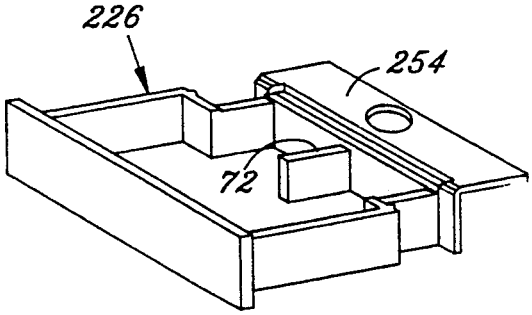
FIG. 17 is also comparable to FIG. 3 but showing a stop for the mid-section of the resilient panel.

FIG. 17 shows a drawer 226 in which the latch section includes an integral stop rib 72 against which flexible panel 254 bottoms out to avoid overstress of the panel 254 in pushing down the button.

Figure 18:
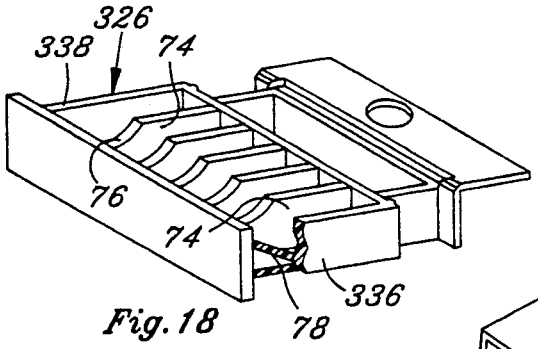
FIG. 18 is a view comparable to FIG. 3, but showing a modified form in which the cavity section is compartmented. A portion of the drawer is broken away to show the ramp.

The FIG. 18 modification includes the drawer 326 compartmenting partitions 74 parallel to the side walls 338 and 336 in which tablets may be lined up on their edge, the front of the compartments being notched out as at 76 to afford easier access to the tablets. Ramps 78 may be formed in the front of the drawer to assist in the "roll-out" of the tablets.

Figure 19:
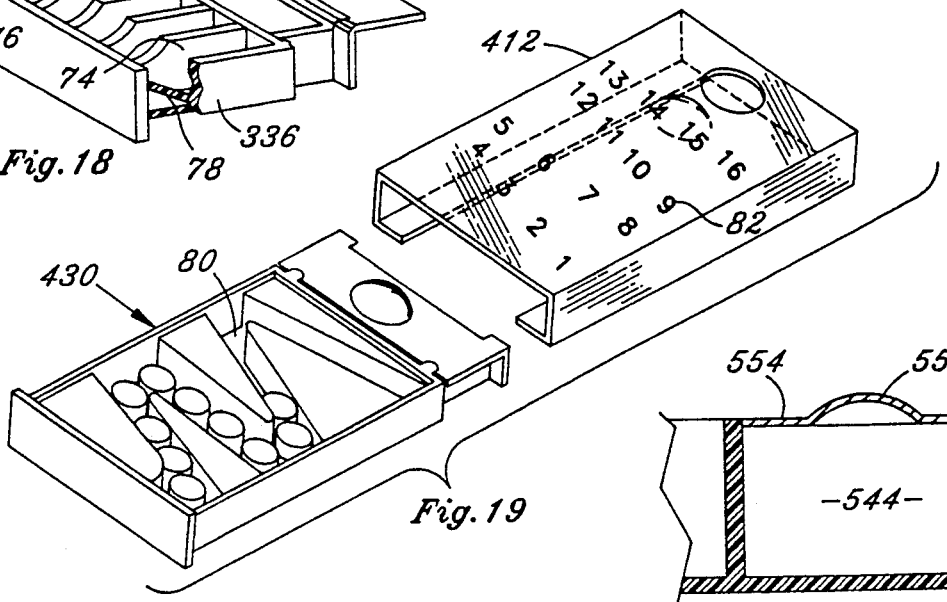
FIG. 19 is an exploded perspective view of a further modification having a compliance feature.

The FIG. 19 modification is similar to the preferred embodiment with the exception that the cavity section 430 is shaped (instead of a rectangular open space) with a zig-zag canal 80 in which the tablets are placed. Additionally, the housing 412 is made of transparent plastic and indicia 82 are molded or printed thereon to overlie positions in the canal 80. Thus, when the dispenser is positioned with its front end down, the tablets fall in pinball fashion to the lower end of the canal and the indicia overlying the position of the upper tablet indicate how many tablets remain in the dispenser. Alternatively, if the indicia 82 are appropriately arranged by the days of the month, for instance, or days of the week, they will indicate to the user whether or not a tablet has been taken that day. This is particularly helpful to forgetful elderly persons.

Figure 20:
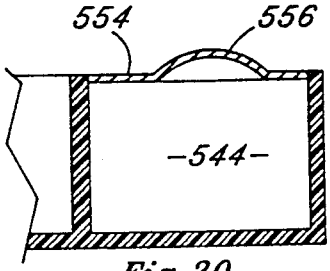
FIG. 20 is a fragmentary sectional view as part of FIG. 13 in which the modified panel is an inserted separate spring element.
Figure 21:
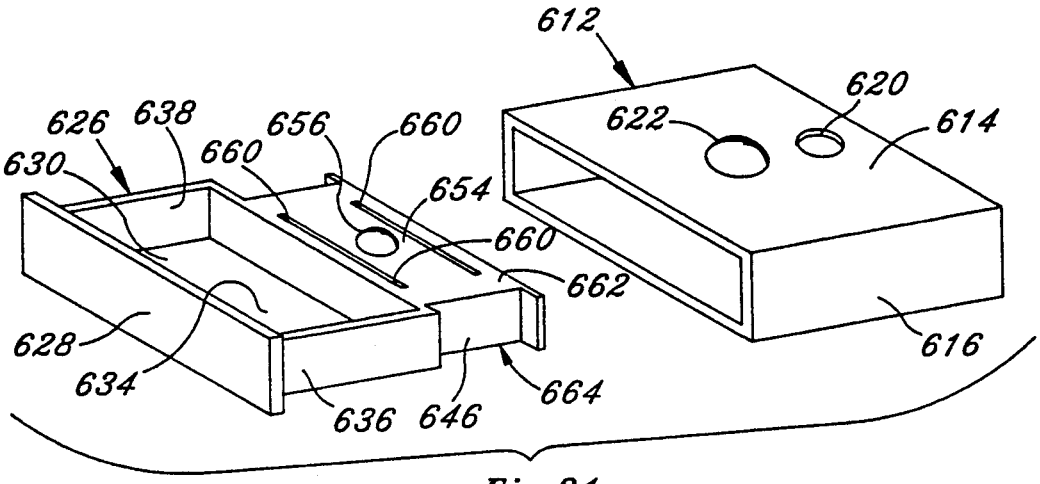
FIG. 21 is an exploded top perspective view of a tablet dispenser embodying the invention and having a modified drawer including an integral latch panel.
Figure 22:
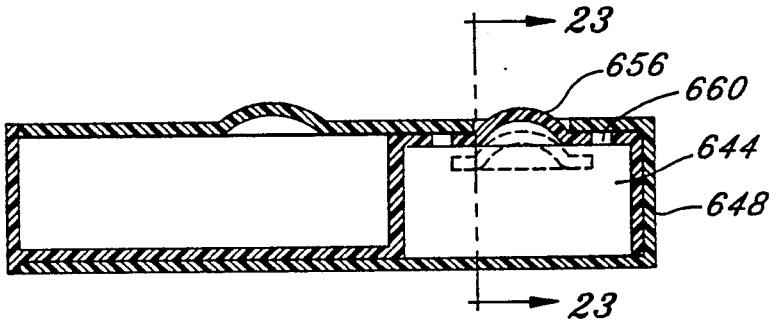
FIG. 22 is a sectional view taken on the line 22—22 of FIG. 21 showing the modified drawer assembled in its housing and showing in dotted lines the depressed position of the latch button panel.
Figure 23:
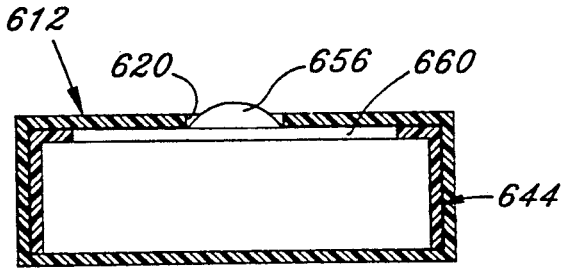
FIG. 23 is a sectional view taken on the line 23—23 of FIG. 22 showing the latch panel in profile.
Figure 24:
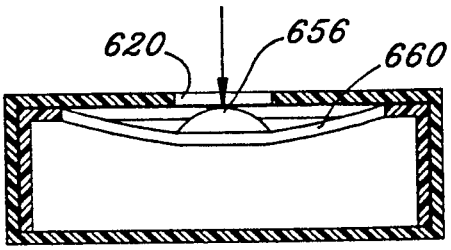
FIG. 24 is similar to FIG. 23 but showing the button depressed as it would be in the opening position.

As an additional modification, FIG. 20 shows that the flexible panel and button of the earlier embodiment may be replaced by a separate resilient panel 554 of metal with its button 556. Such a separate panel may be snapped under nibs (not shown) similar to nibs 58 and supported on the top of the end wall 544 and 546 (not shown). It should be understood that in all other respects a dispenser according to the invention and as shown in FIG. 20, operates identically with the above described dispenser of the FIGS. 1 through 5 embodiment.

In a further modification, shown in FIGS. 21 through 24, the latch button 656 is molded in a latch panel 654 which is defined by a pair of parallel slots 660 in the top wall 662 in the latch section 664. The latch section is an inverted open box (FIG. 22) which is integral with the drawer section 626.

The drawer section comprises the front wall 628, the bottom wall 634, and side walls 636 and 638 which define the tablet receiving cavity 630. Aside from the latch top wall 662, the latch section 664 comprises the side walls 644 and 646 and the rear wall 648, all integral, molded together and unitary with the drawer section 626.

The slots 660 permit the latch panel 654 considerable flexibility and resilience in the area of the button 656. As a result, the button 656 can be depressed through the opening 620 in the top of the housing 612. The relief zone 622 in the hollow of the dome, as shown in earlier embodiments, permits the button to return to its original upward position when the drawer, open to avoid the "cold set" of the latch panel 654 which might otherwise happen without such a dome or other relief zone such as a simple opening. The button and domed section may be as described in connection with FIGS. 7 and 8 to block further opening of the drawer.

The advantage of the FIGS. 21 through 24 embodiment is that the button is molded in place and there is no requirement for hinging the latch section over as with the FIG. 3 embodiment, for instance. There is also no need for a separate latch panel as in the FIG. 20 embodiment.

Figures 28, 29, 30A, 30B, 30C, 31A, 31B, 32A, 32B:
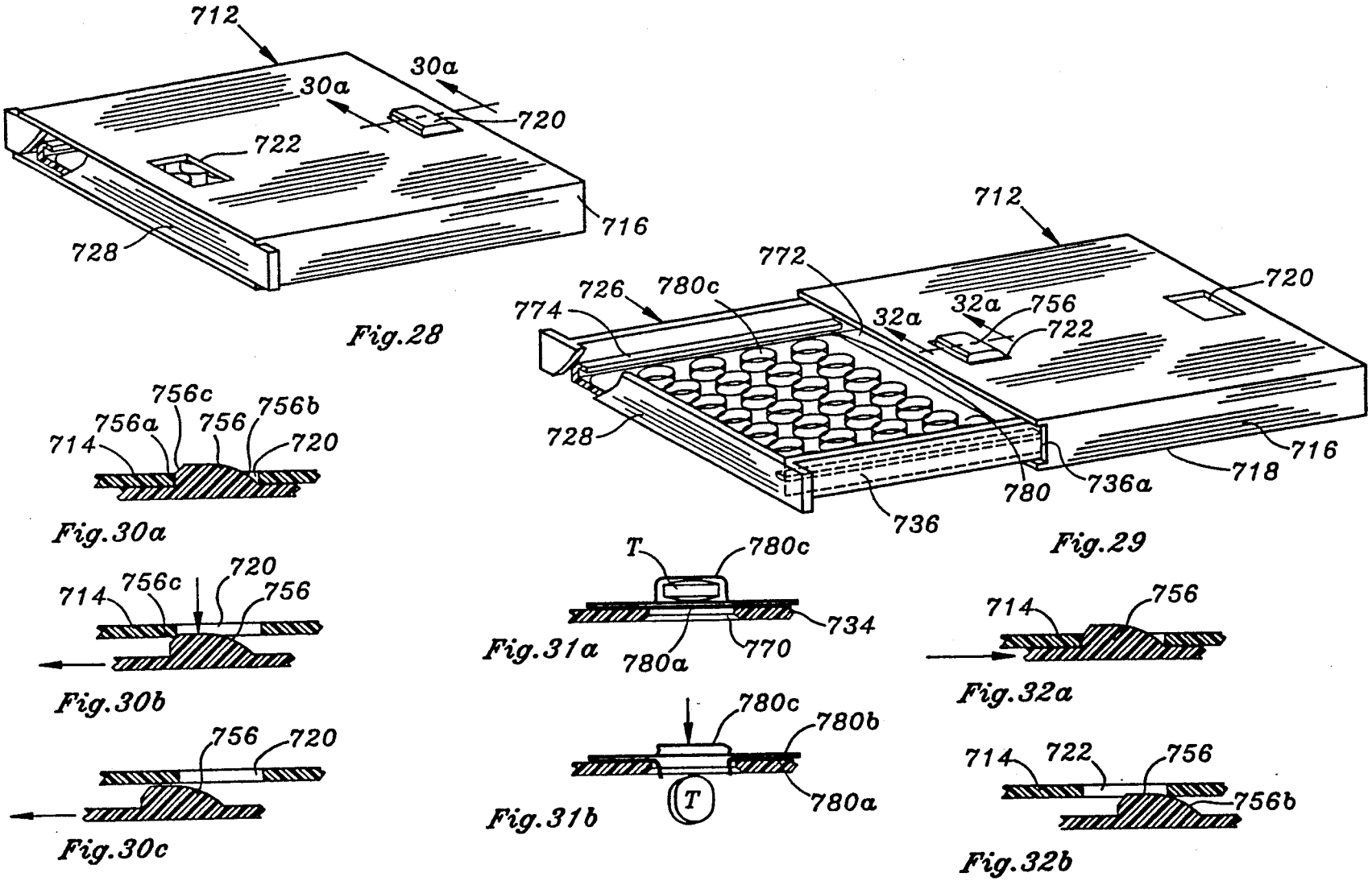
FIG. 28 is a perspective view, with the drawer front partly broken away, of the FIG. 25 emobdiment in closed condition.
FIG. 29 is a view similar to FIG. 28 but showing the container in dispensing condition.
FIG. 30*a* is a fragmentary section view taken on the line 30*a*—30*a* of FIG. 28 showing the latch button in up position.
FIG. 30*b* is similar to FIG. 30*a* but showing the button being pressed downward (vertical arrow) readily for opening motion (horizontal arrow) of the drawer.
FIG. 30*c* shows the drawer being pulled out (horizontal arrow) of the housing.
FIG. 31*a* is a fragmentary sectional view taken across one of the tablet pockets of the dispensing card prior to dispensing. A tablet T is disposed in the pocket.
FIG. 31*b* is similar to FIG. 31*a* but showing the tablet T being dispensed by finger pressure on top of the pocket (vertical arrow)
FIG. 32*a* is a fragmentary sectional view taken on the line 32*a*—32*a* of FIG. 29 showing the latch button up with the drawer in dispensing position and pressure being applied (horizontal arrow) to close the drawer.
FIG. 32*b* shows the latch button moving rearward having been cammed downward by the housing in the relief zone as the drawer is pushed closed.

The modified form of the invention shown in FIGS. 25 through 32*b* comprises, as best shown in FIG. 29 the housing 712 and the drawer 726. The housing comprises the top wall 714, the side walls 716 and a full bottom wall 718. The top wall is provided with an opening 720 spaced back from the front opening of the housing. The top wall is also formed with a relief zone in the form of an opening 722 similar to opening 720 and in line forward of the latter opening.

The drawer 726 (FIG. 25) comprises the side walls 736 and 738, the front wall 728 and the floor or bottom wall 734. The floor 734 is multiply apertured as at 770. Preferably, the rows across the drawer are of seven each for reasons which will appear.

Aside from the cavity section 730, the drawer 726 also comprises the latch section 764 which includes a latch panel 754 bridging between the side walls 736, 738. At the midpoint of the latch panel 754, the panel is formed with an upward rectangular button 756 with a perpendicular front end 756*a* and a sloping rear end 756*b* (FIG. 30*a*). Above the perpendicular front end 756*a* there is a rearwardly and upwardly bevelled section 756*c*.

Figure 26A:
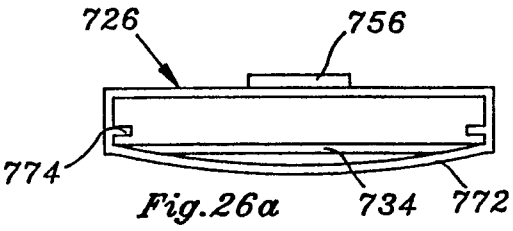
FIG. 26*a* is a rear end view of the FIG. 25 embodiment and showing the drawer in its assembled condition with the dispensing card locking bow bowed downward.
Figure 26B:
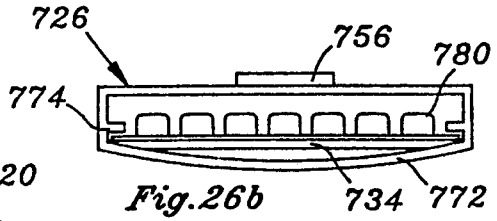
FIG. 26*b* is similar to FIG. 26*a* but showing the dispensing card in place.
Figure 26C:
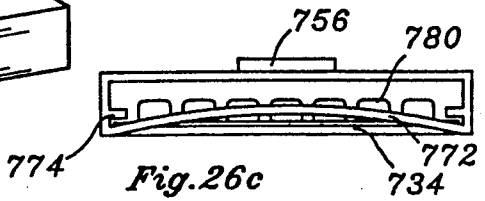
FIG. 26*c* is similar to FIG. 26*b* but showing the locking bow bowed upward to immobilize the card in exact position.

Below the latch panel 754 is the card locking bow 772 (FIGS. 25, 26*a*) which also bridges between the side walls 736 and 738 is before assembly of the unit bowed downward in its center (FIG. 26*a*). Extending inward along the side walls 736, 738 respectively and spaced upward from the floor 734 are a pair of ribs 774.

A dispenser card 780 (FIG. 25), a separate piece from the drawer, is provided. It comprises a thin frangible base layer 780*a* to the upper surface of which is laminated a clear plastic pocketed layer 780*b*. The pocketed layer comprises rows of upward collapsible pockets 780*c* arranged seven in a row to register exactly with the opening 770 and the floor 734 of the drawer. Each of the pockets holds a tablet T or a pill (FIG. 31*a*).

Figure 25:
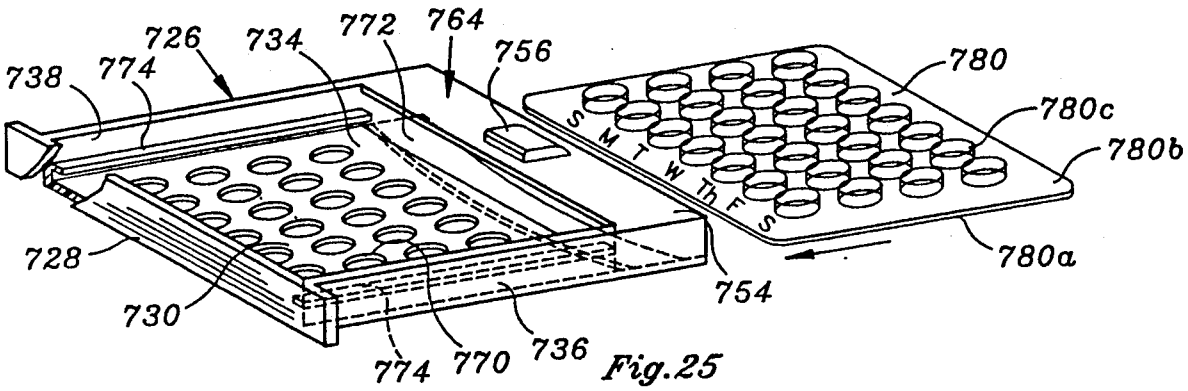
FIG. 25 is a perspective exploded view of the drawer of a further embodiment.

As shown in FIG. 25, the pockets may be identified with intervals of periodicity, for instance, the days of the week, in the embodiment shown. Alternatively the number of pockets in a row may be a different number and marked to indicate the times of the day at which a pill must be taken.

In assembly the card is inserted from the rear of the drawer (FIG. 25) through the opening between the latch panel 754 and the locking bow 772 so that the sides of the card 780 track into the slots 730 under the ribs 774 and come to rest against the front panel 728 of the drawer 726 with the card directly superposing the floor 734 and the pockets in registry above the respective floor openings 770. At this point the locking bow 772 is pressed upward (FIG. 26*b*) to spring up over-center fashion to the bowed upward position (FIG. 26*c*) to lock the card against rearward displacement in the drawer 726. This assures that the pockets 780*c* will remain registered respectively with the openings 770.

In the final stage of assembly, the drawer 726 is aligned in front of the opening of the housing 712 (FIG. 27) and moved inward of the housing. Upon contacting the front edge of the top wall, the latch 756 will be cammed downward as the resilient latch panel 754 flexes down. Upon arriving at the relief zone, that is, opening 722, the latch button 756 will pop up into that opening and, as the drawer is forcibly moved rearward into the housing once again, the latch button 756, because of its rear end cam-shaped surface 756*b*, moves downward (FIGS. 32*a*, 32*b*) to permit the drawer to be moved inward further. Finally, when the drawer is fully in the housing 712, the latch button 756 will pop up in opening 720 to latch the drawer in the closed position.

Figure 27:
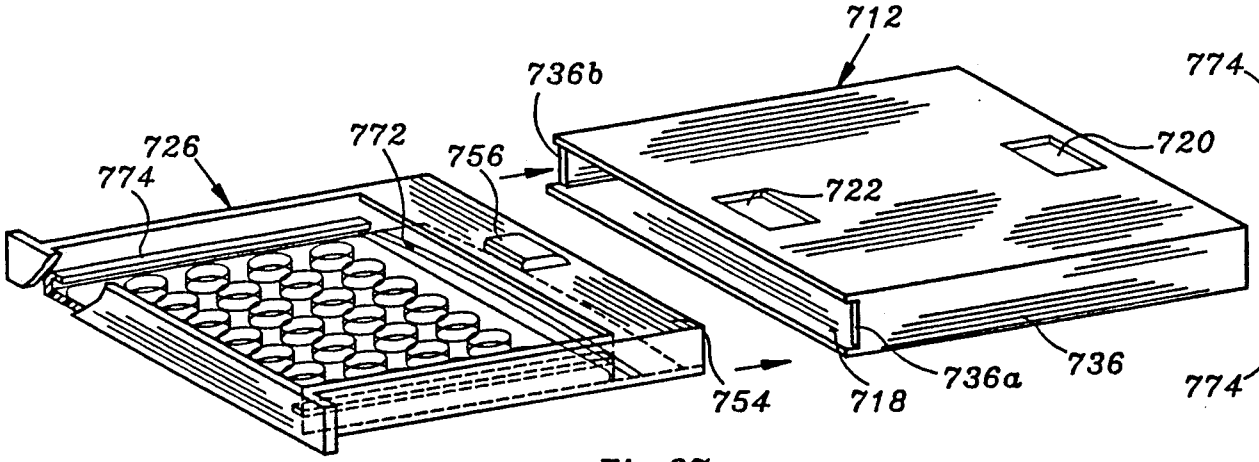
FIG. 27 is an exploded perspective view showing the assembled drawer and housing of the FIG. 25 modification.

It should be noted that the front wall 728 of the drawer has ends which extend laterally beyond the side walls 716 of the housing. When the drawer is closed these ends are accommodated by notches 736*a* and 736*b* (FIG. 27). In the dispensing operation the user will grasp the sides of the drawer front panel 728 with the thumb and forefinger of one hand and with the other hand squeeze downward the button 756 by grasping the rear of the housing by the button 756 and the lower wall 718 with thumb and forefinger.

Actually, it is probably not possible with the thumb or forefinger to press the button 756 down far enough to clear the wall 714 because the size of the opening will not permit it. The purpose of the beveled section 756*c* is to assist in the lowering of the button. As the drawer is pulled forward, section 756*c* contacts the front edge of opening 720, and this contact cams the button down the rest of the way so that the button top can engage the underside of top wall 714.

With the latch button 756 thus downward (FIG. 30*b*) the drawer may be pulled open. Once the button 756 has cleared the opening 720, the button will be held down by top wall 714 and the drawer may be pulled further open. When the drawer reaches the position shown in FIG. 29, the button 756 pops up in the relief zone or opening 722. The perpendicular front wall 756*a* of button 756 butting against the margin of opening 722 prevents further opening of the drawer.

At this point (FIG. 29) the cavity 730 of the drawer 726 is fully exposed and the rows of pockets 780*c* are clearly visible along with their indices of periodicity (for instance, days of the week as shown in FIG. 25). The user then (FIGS. 31*a*, 31*b*) merely presses the top of the proper collapsible pocket 780*c* (FIG. 31*b*). The pocket gives way putting pressure on the pill and forcing it to burst the frangible base layer 780*a* therebelow.

After the user has some experience, he will be able to catch the dropping pill in the palm of the same hand with which he supports the container, or the entire unit may be placed over a table to catch the falling pill.

It will be noted that the apertured floor 734 is firm enough to support the rather fragile card 780 against the pressure of the user's finger as he presses down the pocket 780*c*. In FIG. 31*a* it can be seen that the bottom margins of the openings 770 may be chamfered, whereas the top surface of the floor 734 about the opening is left unchamfered to provide a sharp edge which may assist in the rupture of the base layer 780*a* (FIG. 31*b*).

Once the drawer is opened in the position shown in FIG. 29, it is thus an easy matter for the user to push down the proper pocket 780*c* and dispense the pill thereunder. The markings which are preferably provided for every row show the intervals of periodicity and are a help to the user in determining which pocket to press and so that thereafter there is an automatic indication that the pill has been taken on a given day. The pills are readily dispensed from the open drawer as described above. As a matter of fact, once the drawer has been opened, pills can be pressed down and dispensed even by a child. However, opening the drawer requires the cognitive skills and finger/thumb span of an adult and, hence, the dispenser is indeed child-resistant. The elderly, on the other hand, will find the container readily openable and will be able to dispense the pills without difficulty.

After the single pill is dispensed, the user may close the container by merely pushing in the drawer 726 into the housing and the cam surface 756*b* on the button 756 will press down the button as it moves against the top wall 714 at the margin of opening 722 (FIG. 32*b*). When the drawer is closed all the way, the button 756 will pop up in opening 720 and the perpendicular rear face 756*a* (FIG. 30*a*) will block the opening of the drawer until the button is again depressed and the drawer pulled forward (FIGS. 30*b* and 30*c*). The FIG. 25 through 32*b* modification is thus child-resistant and elderly friendly.

When the dispenser card is exhausted of tablets, it is a simple matter to replace the card 780 with a new card into the drawer 726. It is only necessary to snap the bowed lock 772 from the position shown in FIG. 26*c* to that of 26*b* and then slide out the exhausted card 780 and then slide in a new card under the ribs 774. The bowed lock 772 can then be resnapped from the position shown in FIG. 26*b* to the position shown in FIG. 26*c*. The drawer can then be returned into the housing.

The FIG. 25 through 32*b* modification comprising the drawer 726 and the housing 712 are both molded of a plastic which is resilient in its thinner dimensions, such as those of latch panel 764 and the bowed lock 772.

Even other variations and modifications are envisioned without departing from the spirit of the invention. Thus, while the invention has been shown in a limited number of embodiments, it is not so limited but is of a scope defined by the following claim language which may be broadened by an extension of the right to exclude others from making or using the invention as is appropriate under the doctrine of equivalents.

What is claimed is:

1. A tablet dispenser comprising;

a. an open-fronted housing including a top wall, side walls running longitudinally of the housing and at least a partial bottom wall, the top wall being formed with an opening intermediate the side walls and a domed section longitudinally spaced from and in line with the opening, b. a drawer slideably fitting into the housing and defined by an upwardly facing front cavity section and a rear latch section integral with the front cavity section, the latch section comprising across the top thereof a resilient panel having an upstanding operating button formed therein intermediate the side walls of the housing and moving up into latch position in the opening when the drawer is in closed position, the button being manually depressable to a release position so that the drawer may be opened to a dispensing position in which the button moves up into the domed section, the shape of the domed section and button being such that the drawer may be forceably closed from dispensing position as the button is cammed downward by the domed section.

2. A tablet dispenser as claimed in claim 1 wherein a partial block is fixedly positioned in the front of the drawer making accessible for removal only a single tablet.

3. A tablet dispenser as claimed in claim 1 wherein the latch section is provided with a rear wall portion and the resilient panel is integral with and hinged to the rear wall and extends forward therefrom and is supported from below at the side edges thereof by other structure of the latch section.

4. A tablet dispenser as claimed in claim 3 wherein the latch section at the front thereof is formed with nibs which hold down the front of the panel.

5. A tablet dispenser as claimed in claim 1 wherein the latch section comprises connected frame members and the resilient panel is a separate element secured to one or more of the frame members.

6. A tablet dispenser as claimed in claim 1 wherein both the button and the front of the domed section have vertical sections which mutually abutt to block farther movement of the drawer toward the front of the housing.

7. A tablet dispenser as claimed in claim 1 wherein the opening has a chamfer at its lower end and the button has a fillet at its lower end, the chamfer and fillet serving to center the button in the opening as it moves up when the drawer closes.

8. A tablet dispenser as claimed in claim 1 wherein the cavity section has a cavity in the form of a zig-zag canal and the top wall of the housing is transparent and bears indicia overlying the canal when the drawer is closed to indicate the number of tablets in the canal.

9. A tablet dispenser as claimed in claim 1 wherein the cavity section has one extension accessible to tablets in the cavity section through a passage in a side wall of the cavity section and the top wall of the housing has a depending partition which, when the drawer is open, closes the passage, the extension holding only a given number of tablets.

10. A tablet dispenser as claimed in claim 1 wherein the button is formed with a lateral recess toward the front of the dispenser and the opening has a lateral tongue aligned with the recess when the button is in its up position.

11. A tablet dispenser as claimed in claim 1 wherein the bottom wall of the housing is only partial, exposing a portion of the bottom wall of the drawer, the latter being provided with ribs.

12. A tablet dispenser comprising:

a. an open-fronted housing including a top wall, side walls running longitudinally of the housing and at least a partial bottom wall the top wall being formed with an opening intermediate the side walls and a domed section longitudinally spaced from and in line with the opening, b. a drawer slideably fitting into the housing and including across the top thereof a resilient panel having an upstanding operating button formed therein intermediate the side walls of the housing and moving up into latch position in the opening when the drawer is in closed position, the button being manually depressable to a release position so that the drawer may be opened to a dispensing position in which the button moves up into the domed section, the shape of the domed section and button being such that the drawer may be forceably closed from dispensing position as the button is cammed downward by the domed section.

13. A tablet dispenser comprising:

a. an open-fronted housing including a top wall, side walls and at least a partial bottom wall, one wall being formed with a button opening and a relief zone formed toward the front in said one wall of the housing in alignment with the button opening, b. a drawer slideably fitting into the open front of the housing and defined by an upwardly facing front cavity section and a latch integral with the front cavity section, the latch comprising a resilient panel parallel to and inward from the said one wall and having an operating button formed therein and moving into latch position in the button opening when the drawer is in closed position, the button being manually depressable from said button opening as the panel flexes to a release position so that the drawer may be opened to a dispensing position whereat the button moves up in the relief zone such that it is no longer depressed, to relieve stress on the resilient panel.

14. A tablet dispenser as claimed in claim 13 wherein the button opening and relief zone are on the top wall and the relief zone is in the form of a dome.

15. A tablet dispenser as claimed in claim 14 wherein the resilient panel is under the top wall and the button faces upward and the panel is supported by side walls of the drawer parallel to the side walls of the housing.

16. A tablet dispenser as claimed in claim 13 wherein the drawer is a single part of molded plastic.

17. A tablet dispenser as claimed in claim 1 wherein the drawer is a single part of molded plastic.

18. A tablet dispenser comprising:

a. an open-fronted housing including a top wall, side walls running longitudinally of the housing and inward drawer retaining means extending inward from the side walls and spaced down from the top wall, the top wall being formed with a button opening intermediate the side walls and a relief zone spaced toward the front from and in line with the opening, b. an integrally molded drawer slideably fitting into the open front of the housing and defined by an upwardly facing front cavity section and a rear latch section integral with the front cavity section, the latch section comprising a latch wall across the top thereof, a resilient panel portion in the latch wall defined by spaced elongate parallel slots in the latch wall, the panel having an upstanding operating button formed therein between the slots and moving up into latch position in the button opening when the drawer is in closed position, the button being manually depressable to a release position so that the drawer may be opened to a dispensing position in which the button moves up into the relief zone.

19. A tablet dispenser as claimed in claim 18 wherein the relief zone is a domed section and the shape of the domed section and button is such that the drawer may be forceably closed from dispensing position as the button is cammed downward by the domed section.

20. A tablet dispenser as claimed in claim 19 wherein the latch section comprises connected frame members and the latch wall is secured to said frame members.

21. A medicine dispenser comprising:

a. an open-fronted housing defined by a plurality of connected walls and including a first wall extending rearward from the front, the first wall being formed with a button opening and a relief zone spaced toward the front from the opening and in line with the opening, b. a drawer slideably fitting into the open front of the housing and defined by a forward medicine-containing section and a rear latch section integral with the medicine-containing section, the latch section supporting a resilient latch panel parallel to and closely adjacent the first wall, the panel having an upstanding operating button therein biased by the resilient latch panel up into latch position in the button opening when the drawer is in closed position, the button being manually depressable to a release position so that the drawer may be opened to a medicine-dispensing position in which the button moves up into the relief zone.

22. A medicine dispenser as claimed in claim 21 wherein the button and the relief zone have on their respective front surfaces means to block the drawer from further opening movement beyond the dispensing position.

23. A medicine dispenser as claimed in claim 21 wherein the resilient latch panel is molded plastic integral with the latch section, and the medicine-containing section.

24. A medicine dispenser as claimed in claim 21 wherein the rear of the button and the relief zone are shaped so that the button is automatically cammed inward when the drawer is forced into the housing from the dispensing position.

25. A medicine dispenser as claimed in claim 21 wherein the drawer has a front wall having outward extensions protruding respectively laterally beyond the sides of the housing to assist in the opening of the drawer.

26. A medicine container comprising:

a. an open-fronted housing defined by a plurality of connected walls and including a first wall extending rearward from the front, the first wall being formed with an opening and a relief zone spaced toward the front from the opening and in line with the opening, b. a drawer slideably fitting into the open front of the housing and defined by a forward medicine-containing section and a rear latch section integral with the medicine-containing section, the latch section supporting a resilient latch panel parallel to and closely adjacent the first wall, the panel having an upstanding operating button therein biased by the resilient latch panel up into latch position in the opening when the drawer is in closed position, the button being manually depressable to a release position so that the drawer may be opened to a medicine-dispensing position in which the button moves up into the relief zone, the medicine-containing section comprising a rigid floor having a plurality of spaced openings therein, the floor containing a bubble-pack card having a frangible base and a cover sheet comprising spaced collapsible pockets laminated thereto, the pockets each containing a tablet, the card carrying an indicator of periodicity for each pocket, the pockets and tablets being aligned respectively over the openings in the rigid floor.

27. A medicine container as claimed in claim 26 wherein the card may be slid into the drawer from the rear thereof to rest on the rigid floor, sidewalls in the drawer, and retaining means on the drawer holding the card in position in the drawer.

28. A medicine container as claimed in claim 27 wherein the retaining means comprises ribs along sides of the drawer spaced above the floor and adapted to overlie the card, and a rear lock section comprising a bridge across the drawer between the sides and bowing down in its central section and, after assembly, the central section can be pushed up to snap upward to lock the card from being slid back out of the drawer.

29. A medicine dispenser as claimed in claim 28 wherein the latch panel also bridges between the sidewalls and is disposed above the lock.

30. A medicine dispenser as claimed in claim 26 wherein the relief zone is a second opening.

31. A medicine dispenser as claimed in claim 30 wherein the drawer has a front wall having outward extensions protruding respectively laterally beyond the sides of the housing to assist in the opening of the drawer.

* * * * *